US007047603B2

(12) United States Patent
Holliday et al.

(10) Patent No.: US 7,047,603 B2
(45) Date of Patent: May 23, 2006

(54) RETAINER CLIP

(75) Inventors: Ronald D. Holliday, Clinton Township, MI (US); Eric C. Peterson, Northville, MI (US)

(73) Assignee: Peterson American Corporation, Southfield, MI (US)

( * ) Notice: Subject to any disclaimer, the term of this patent is extended or adjusted under 35 U.S.C. 154(b) by 226 days.

(21) Appl. No.: 10/700,010

(22) Filed: Nov. 3, 2003

(65) Prior Publication Data

US 2005/0091806 A1 May 5, 2005

(51) Int. Cl.
*A44B 21/00* (2006.01)

(52) U.S. Cl. ..... 24/546; 206/451

(58) Field of Classification Search ..... 24/27, 24/29, 546

See application file for complete search history.

(56) References Cited

U.S. PATENT DOCUMENTS 1,039,995 A 10/1912 Niles
1,099,759 A 6/1914 Niles
2,208,842 A * 7/1940 Harvey ..... 206/340
2,299,490 A * 10/1942 Newman ..... 24/457
2,393,514 A * 1/1946 Bicknell ..... 206/451
2,472,756 A 6/1949 Nelsson
2,668,342 A 2/1954 Nelsson
4,073,462 A 2/1978 Whitaker
4,143,845 A 3/1979 Harris
4,152,256 A 5/1979 Wennberg
4,201,013 A * 5/1980 Robbins ..... 47/44
4,835,934 A 6/1989 Swenson
5,165,722 A * 11/1992 Wong ..... 281/42
5,165,723 A * 11/1992 Evans ..... 281/42
5,553,822 A 9/1996 Barnard
5,810,399 A 9/1998 Platano

* cited by examiner

*Primary Examiner*—Robert J. Sandy
(74) *Attorney, Agent, or Firm*—Harness, Dickey & Pierce, P.L.C.

(57) ABSTRACT

A flexible wirelike retainer clip is adapted to hold a plurality of disc-like rings in a stacked assembly. The retainer clip is resilient and can be selectively actuated to hold the rings in a stacked position to facilitate handling for various purposes such as processing the rings while stacked, shipping the rings while stacked and to facilitate release of the rings for assembly to other components. The resilience of the retainer clip facilitates accommodating stacks of rings within a range of varying lengths.

37 Claims, 9 Drawing Sheets

FIG - 12
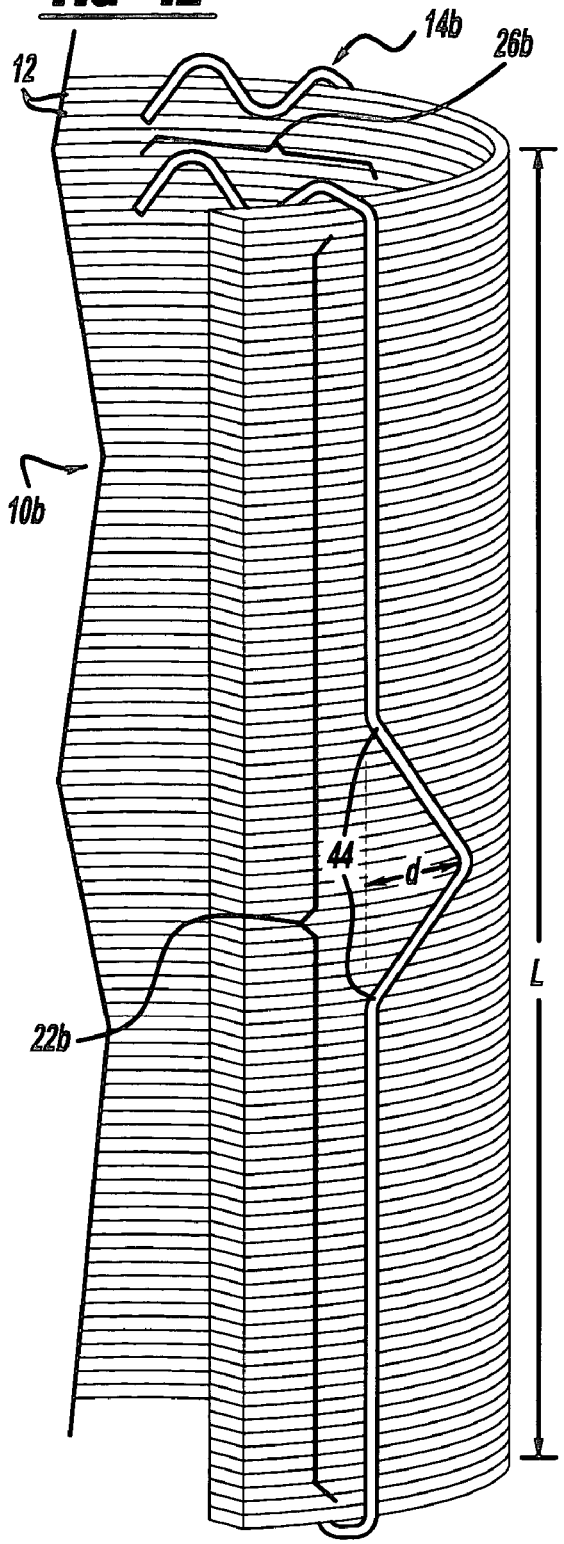
FIG - 14
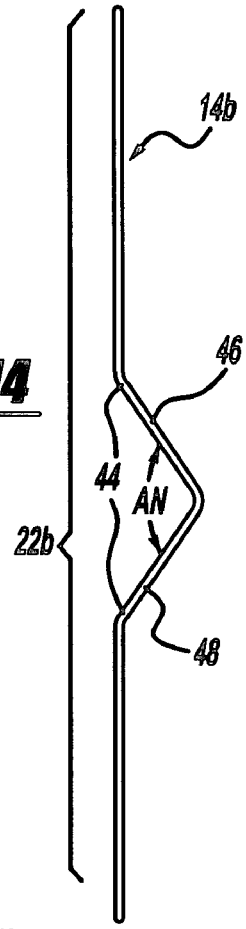
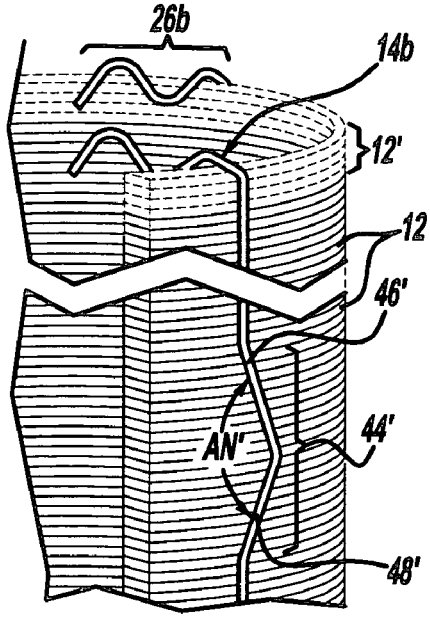
FIG - 15

38d
34d
14d
26d
12
56
34d
14d
10d
44d
22d
24d 26d
32d
56
36d
34d
38d 22d
44d
14d
24d 21
21
56
14d
22d
44d 38d
36d
44d
34d
56

RETAINER CLIP

FIELD OF THE INVENTION

The present invention relates to a flexible wirelike retainer clip for clamping a plurality of coiled or disc-like ring members in a stack to facilitate handling of the ring members for processing and shipping and ultimate use by customers and end users and to the method of securing such ring members in a stack for handling.

BACKGROUND OF THE INVENTION

In the production of coiled or disc-like retaining rings made of a metallic material, it is a common practice to stress relieve or heat treat the rings to a desirable strength and minimize stress concentrations occurring in the initial formation of the rings. In order to assist such processing, it has been common to stack and wrap a plurality of the rings in an aluminum foil wrap for manual handling. In some instances, such as for example retaining rings, the rings are formed with a circumferential gap or opening. Here the customer, or end user, may desire that the rings to be stacked with the gaps oriented. This can be accomplished to a fair degree by the foil wrap. Depending on the material thickness, at times over one hundred rings would be stacked and wrapped in foil. The rings were then heat treated while in the foil wrap. After heat treat, the rings, while still contained in the foil wrap, were air cooled and the inside diameter of this stack of rings was later sprayed or otherwise coated with oil or other corrosion inhibitor to inhibit corrosion. To further ensure against corrosion, the foil wrapped stacks could be placed in specially treated "VCI" plastic bags; i.e. volatile corrosive inhibitors. Again the stacked rings as held in the foil wrap did assist to some degree in the manual handling for initiation of heat treat and subsequent anti-corrosion coating, or oiling, and for shipping to the end user and handling of the rings by the end user for assembly on certain components. The present invention is directed to a manually or mechanically actuable retainer clip for holding the rings together with a desired orientation of the rings, including gap orientation, without the need of foil wrapping and to thereby simplify handling for processing and shipping and handling by the customer and to improve the heat treat and oiling or other corrosion inhibitor procedures. At the same time, the clips firmly clamp the rings in the stack. In addition, the retainer clip can be saved and used repeatedly.

SUMMARY OF THE INVENTION

By comparison to the prior use of the foil wrap, the present invention utilizes a flexible wirelike retainer clip for holding the plurality of rings in a stacked and oriented condition for heat treat and possible subsequent oiling by spray or immersion to inhibit corrosion. As will be seen the wirelike clip can be constructed of various forms. In this regard, it could be further simplified by total immersion or spraying oil on the stack of rings after heat treat from the outside diameter and inside diameter both of which are fully opened as held by the retainer clips. The stack of rings as clamped together in a stack by the retainer clips can be readily conveyed or otherwise transferred from the heat treat station to an air cooling area. Now after treatment, the plurality of rings are shipped to the manufacturer with the clips still holding them stacked firmly together in a desired alignment to facilitate handling by the end user. Thus this facilitates handling for heat treat and shipping and for subsequent handling and use by the end user.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 12 is a fragmentary perspective view similar to FIG. 7 depicting the stack of retaining rings held together by a plurality of wirelike retainer clips of a modified form of the retainer clip of FIGS. 7–11 with the retainer clip having a resilient length or height extension segment;

FIG. 14 is an end elevational view of the retainer clip of FIG. 13;

FIG. 15 is a fragmentary perspective view of a portion of the view of FIG. 12 depicting the actuation of the extension segment to accept additional retaining rings, shown in phantom, in the stack in comparison to the number of rings in the stack depicted in FIG. 12;

DETAILED DESCRIPTION OF THE PREFERRED EMBODIMENTS

The following description of the preferred embodiment(s) is merely exemplary in nature and is in no way intended to limit the invention, its application, or uses.

Figure 1:
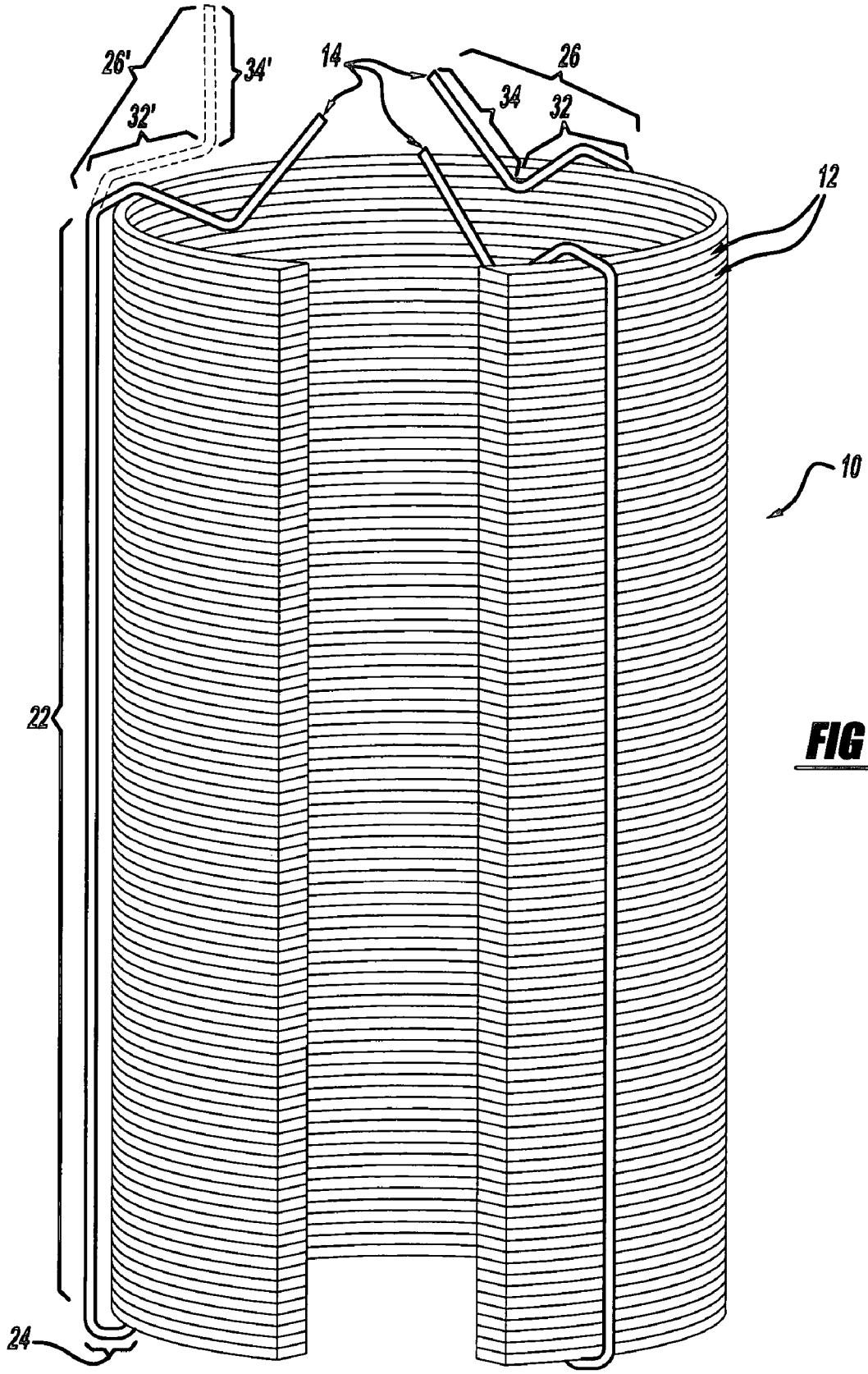
FIG. 1 is a perspective view of a stack of retaining rings held together by a plurality of retainer clips of one form of the present invention with each of the retainer clips being of a wirelike type and having a support section at the bottom and a resilient clamp section at the top with one of the clamp sections shown in phantom in a bent position for initiation of gripping for clamping the rings against the bottom support section in a stack or releasing the rings from the stack.
Figure 6:
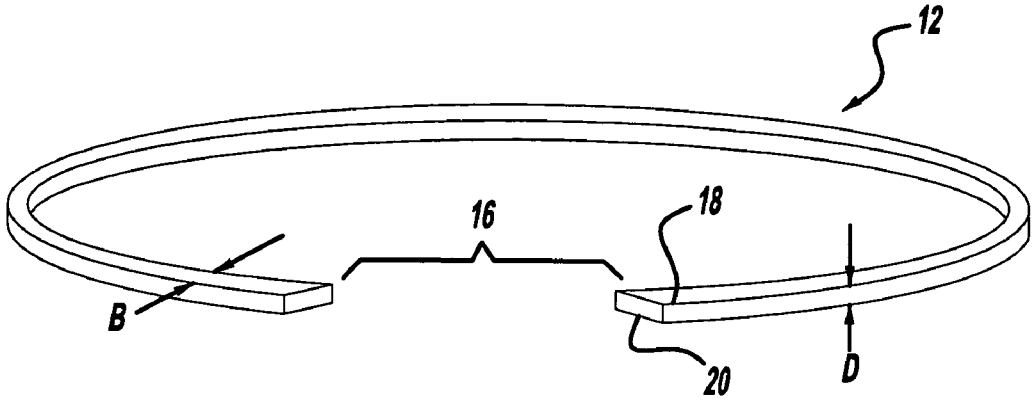
FIG. 6 is a perspective view of one of the retaining rings of FIG. 1.

Looking now to FIG. 1, an assembly 10 is shown of a plurality of retaining rings 12 held in a stacked condition by a plurality of wirelike retainer clips 14. The details of one form of a ring 12 are shown in FIG. 6. The retaining ring 12 is generally circular and of a split ring type with a gap or an opening 16 which is provided to facilitate assembly onto a component such as a transmission shaft. Here the upper surface 18 and bottom surface 20 are generally flat and of a rectangular cross section. In this regard the rings 12 when stacked are held in an oriented arrangement with the gaps or openings 16 in line. This orientation as secured by the clips 14 also assists the end user in maneuvering the rings 12 for assembly to other components in a manufacturing operation. This is especially true for automated systems. Typically a retaining ring such as ring 12 would be made of a high strength alloy steel such as ASTM A229, A277 or A228. It should be understood that other types and forms of members in stacked structures could be handled with the retainer clips of the present invention. Also rings of an oval circumference, wave rings or rings without an opening or gap, such as opening 16, could be handled. Also rings with other cross sections such as a beveled cross section, could be handled and would not impede stacking. In this regard the ring 12 is of a retaining type for use in retaining other members on a transmission shaft. Also some rings can be of a type adapted to fit in grooved housing bores. The clip 14, and variations thereof, can be adapted to handle a variety of such rings.

Figure 22A:
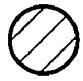
FIG. 22*a* is a sectional view of a typical cross-section of the retainer clips taken generally in the direction of the Arrows 22*aa*—22*aa* in FIG. 3 showing the wire clip to have a circular cross section.

The details of the retainer clip 14 can be best seen in FIGS. 2–5. In one form, the wirelike clip 14 is made from a wire of a resilient, high strength metal and, in one form, has a generally circular cross-section as shown in FIG. 22*a*. The clip 14 has an elongated straight, connecting section 22 terminating at the bottom in a lower support section 24 defined by an open loop. A resilient clamp section 26 is located at the opposite, upper end of the connecting section 22. Thus the straight, connecting section 22 connects the lower support section 24 with the upper clamp section 26. It should be understood that connecting sections, support sections and clamp sections of different contours could be used.

Figure 5:
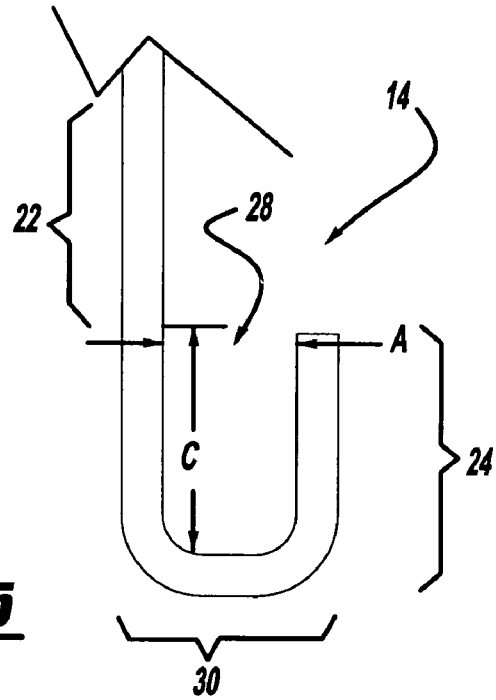
FIG. 5 is an enlarged fragmentary view of a portion of the retainer clip of FIG. 2 taken in the Circle 5 in FIG. 2.

Looking now to FIG. 5, the lower support section 24 defines a downwardly extending hook or open loop 28 having a preselected width A. The width A is substantially greater than the width B of the ring 12. This facilitates insertion of the rings 12 into the open loop 28 of the support section 24. In addition the depth C of the open loop 28 is substantially greater than the thickness D of the rings 12. In one form of the invention the depth C was selected to be around twice the thickness D of the rings 12 such that at least around two rings 12 will be located within the open loop 28 in stacking the rings 12. Also the bottom segment 30 of the open loop 28 is generally straight to provide a generally uniform contact with the bottom ring surface 20. Of course, the contour of the bottom segment 30 could be varied for different applications. In this regard, a generally V-shaped contour could be used with a radius at a bottom crest or peak.

Figure 2:
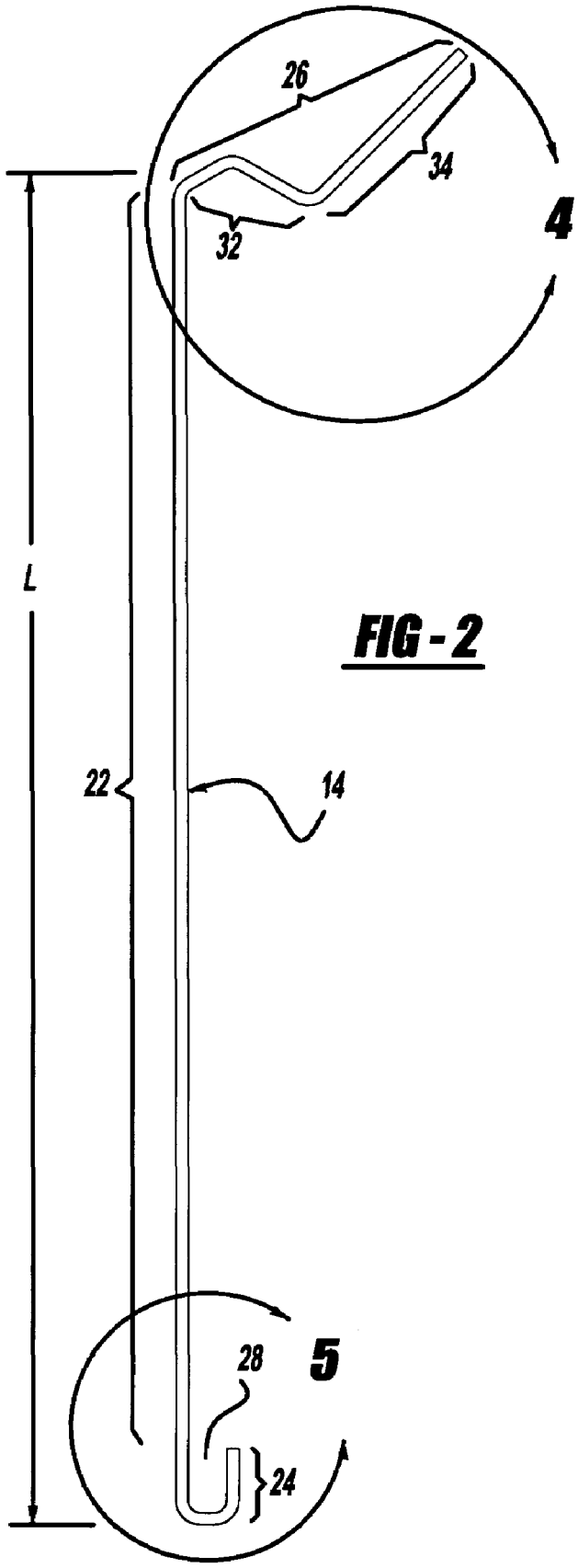
FIG. 2 is a side elevational view of one of the retainer clips of FIG. 1.
Figure 3:
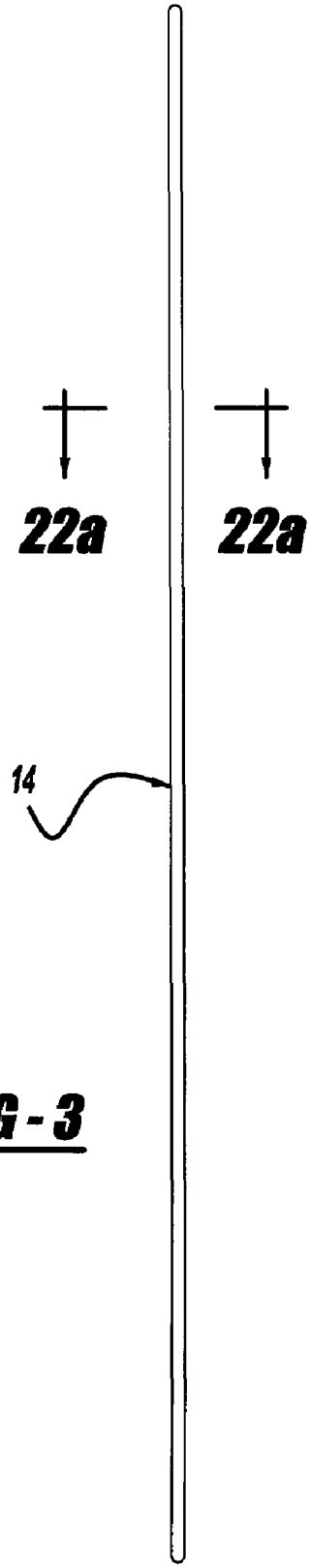
FIG. 3 is an end elevational view of the retainer clip of FIG. 2.
Figure 4:
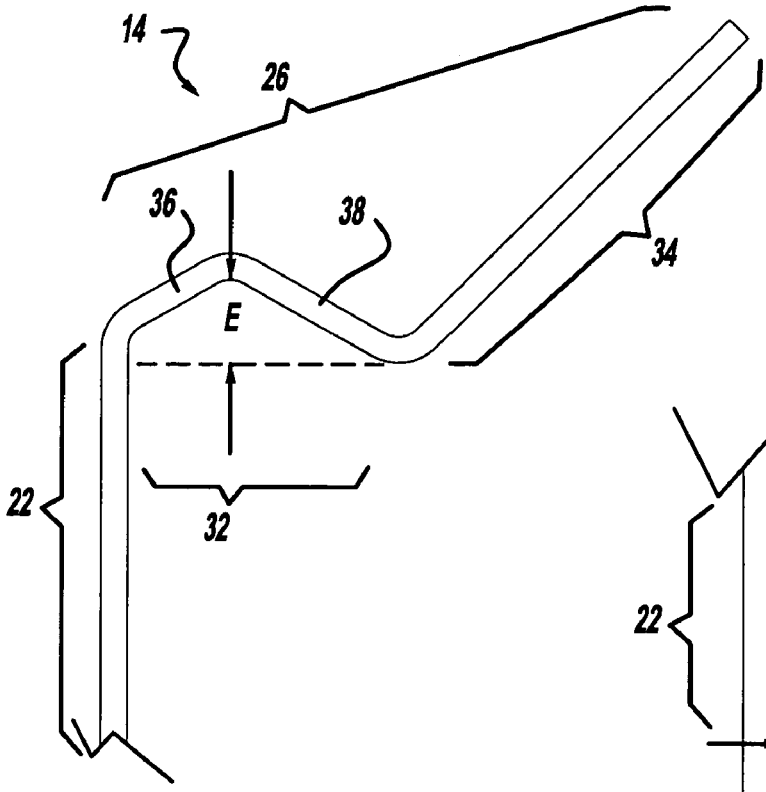
FIG. 4 is an enlarged fragmentary view of a portion of the retainer clip of FIG. 2 taken in the Circle 4 in FIG. 2.

Looking now to FIGS. 2 and 4, the resilient clamp section 26 extends laterally from the straight connecting section 22 in the same direction as the lower support section 24. The upper clamp section 26 has a clamping segment 32 connected to an actuating segment 34. The clamping segment 32 has an open loop which in one form is generally in the shape of an inverted V and has an upwardly extending angulated arm portion 36 connected to a downwardly extending angulated arm portion 38. The depth E of the inverted V is selected to overlap around at least two of the rings 12 at the upper end of the stack of rings 12. Since the clamping segment 32 is resilient it can readily accommodate a reasonable range of dimensional variations of the overall height of the stack of rings 12 with different sizes and numbers of rings 12 in a stack, i.e. in one situation the clamping segment 32 could resiliently accommodate a variation in the total number of rings 12 and a variation of the thickness D of the rings. As will be seen, additional means can be provided to increase the range of the overall height of the stack of rings 12 that can be accommodated.

The outer end of the downwardly extending arm portion 38 is connected to the actuating segment 34 which in turn is angulated upwardly away from the clamping segment 32. The actuating segment 34 is adapted to be engaged by an operator so that the clamping segment 32 can be resiliently moved upwardly to facilitate insertion of the stack of rings 12 into the open loop 28 of the bottom support section 24. With the stack of rings 12 extending fully from the bottom support section 24, the clamping segment 32 can be resiliently bent upwardly and away from the upper end of the stack of rings 12 by upward pressure on the actuating segment 34 by the operator. Then the clamping segment 32 is moved over the top of the stack of rings 12. Next the actuating segment 34 is released whereby the clamping segment 32 will be resiliently moved over the top of the upper ones of the stack of rings 12 to then hold the rings 12 firmly in the stacked arrangement for handling as noted. The upward position of the clamp section 26 with its clamping segment 32 is shown in phantom in FIG. 1 and indicated by the prime numbers, i.e. clamp section 26', clamping segment 32' and actuating segment 34'. Now the end user will simply reverse the above noted process to manually remove the clamp section 26' and clamping segment 32' out of engagement with the stack of rings 12 to release the rings 12 for use such as assembly to other components. It will be seen that other forms of actuating segments can be utilized.

Three retainer clips 14 generally uniformly circumferentially spaced as shown in FIG. 1 can be used to securely clamp the stack of rings 12 together for handling as noted. Of course, two or more than three retainer clips 14 may be desirable in some cases.

A modified form of the retainer clip 14 is shown in FIGS. 7–11. There the like components will be given the same numerical designations with the addition of the postscript letter "a". Unless described otherwise the similarly numbered components will be the same and function the same.

Figure 7:
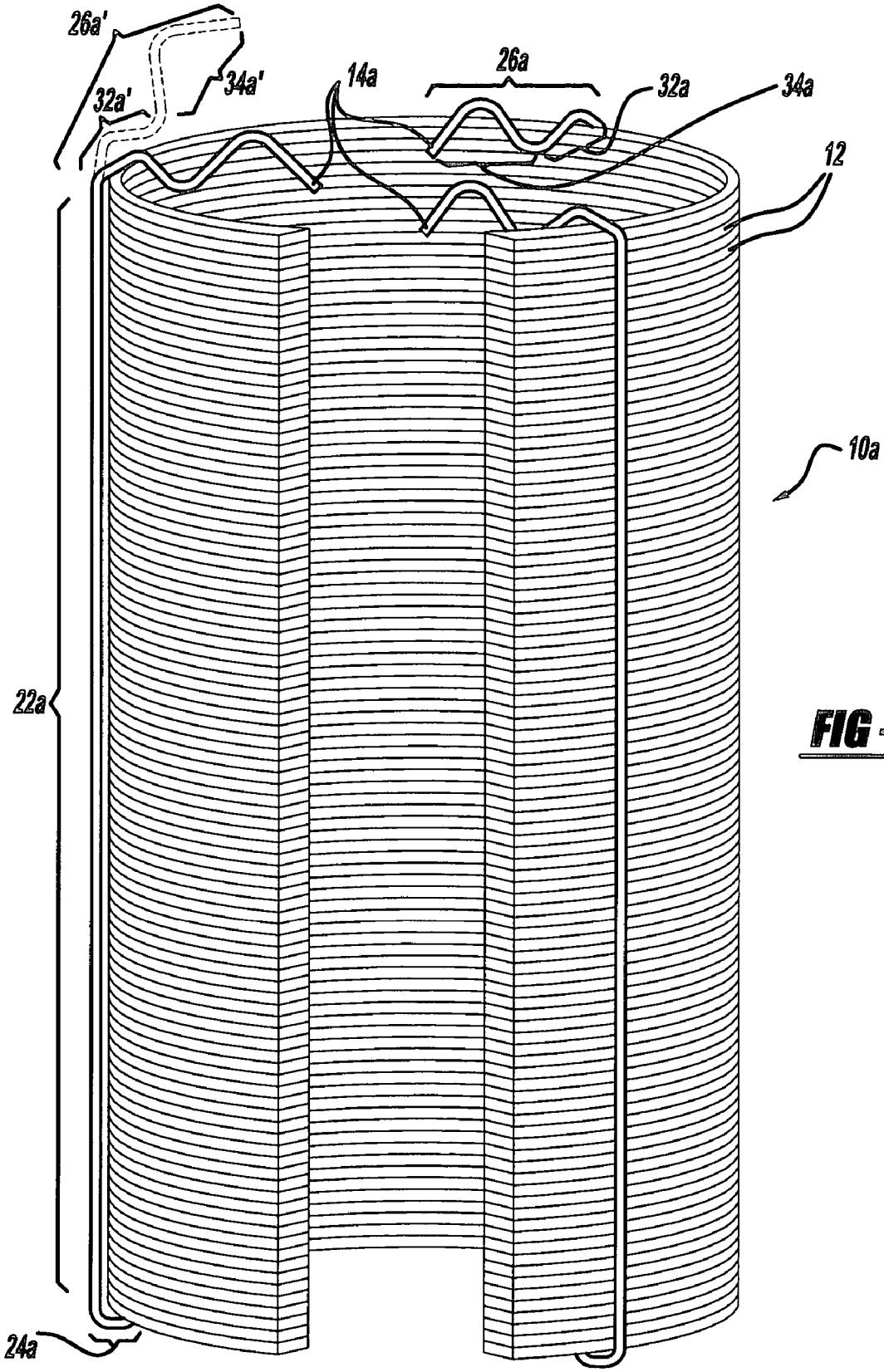
FIG. 7 is a perspective view similar to FIG. 1 depicting the stack of retaining rings held together by a plurality of wirelike retainer clips of a modified design with each of the retainer clips having a support section at the bottom and a resilient clamp section at the top with one of the clamp sections shown in phantom in a bent position for gripping the rings against the bottom support section in a stack or releasing the rings from the stack.

Looking now to FIG. 7, an assembly 10*a* is shown of a plurality of the retaining rings 12 held in a stacked condition by a plurality of wirelike retainer clips 14*a*. Again the details of one form of a ring 12 are shown in FIG. 6.

The details of the retainer clip 14*a* can be best seen in FIGS. 8–11. As noted with clip 14, the wirelike clip 14*a* is made from a wire of a resilient, high strength metal and, in one form, has a generally circular cross section. The clip 14*a* has an elongated straight, connecting section 22*a* terminating at the bottom in a lower support section 24*a* defined by an open loop. A resilient clamp section 26*a* is located at the opposite, upper end of the straight connecting section 22*a*.

Figure 11:
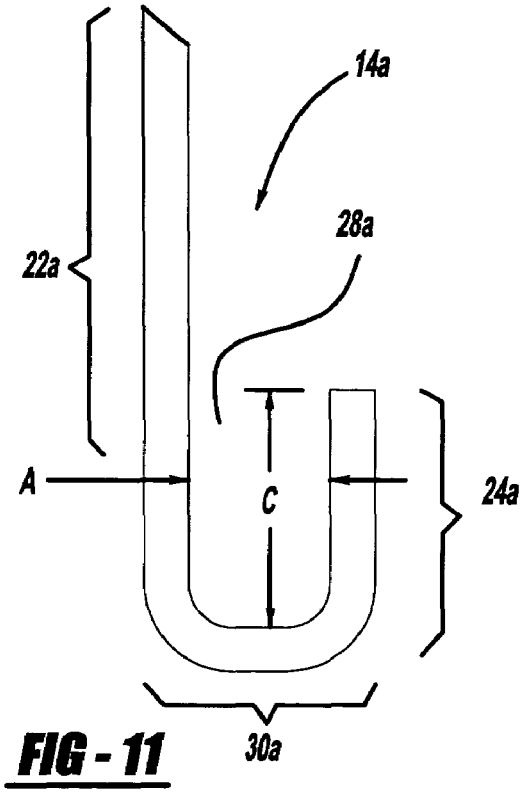
FIG. 11 is an enlarged fragmentary view of a portion of the retainer clip of FIG. 8 taken in the Circle 11 in FIG. 8.

Looking now to FIG. 11, the lower support section 24*a* defines a downwardly extending open loop or hook 28*a* having the preselected width A, which, as noted with clip 14, is substantially greater than the width B of the ring 12. This facilitates insertion of the rings 12 into the open loop 28*a* of the support section 24*a*. Also as noted with clip 14, the depth C of the open loop 28*a* is substantially greater than the thickness D of the rings 12. Again in one form of the invention the depth C was selected to be around twice the thickness D of the rings 12 such that at least around two rings 12 will be located within the open loop 28*a* in stacking the rings 12. Also the bottom segment 30*a* of the open loop 28*a* is generally straight to provide a generally uniform contact with the bottom ring surface 20. As noted the contour of the bottom segment 30*a* could be varied for different applications.

Figures 8, 9:
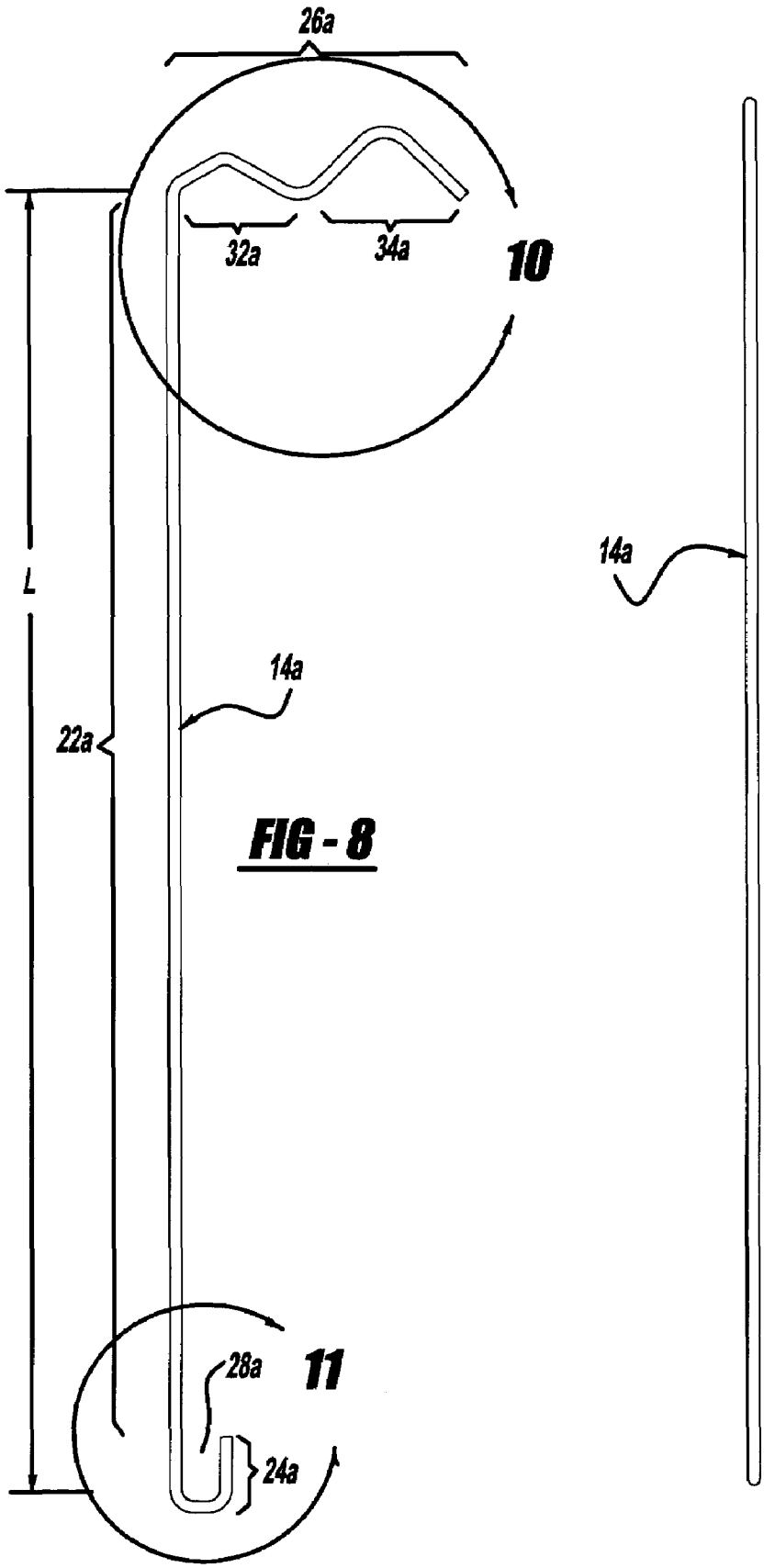
FIG. 8 is a side elevational view of one of the modified retainer clips of FIG. 7.
FIG. 9 is an end elevational view of the retainer clip of FIG. 8.
Figure 10:
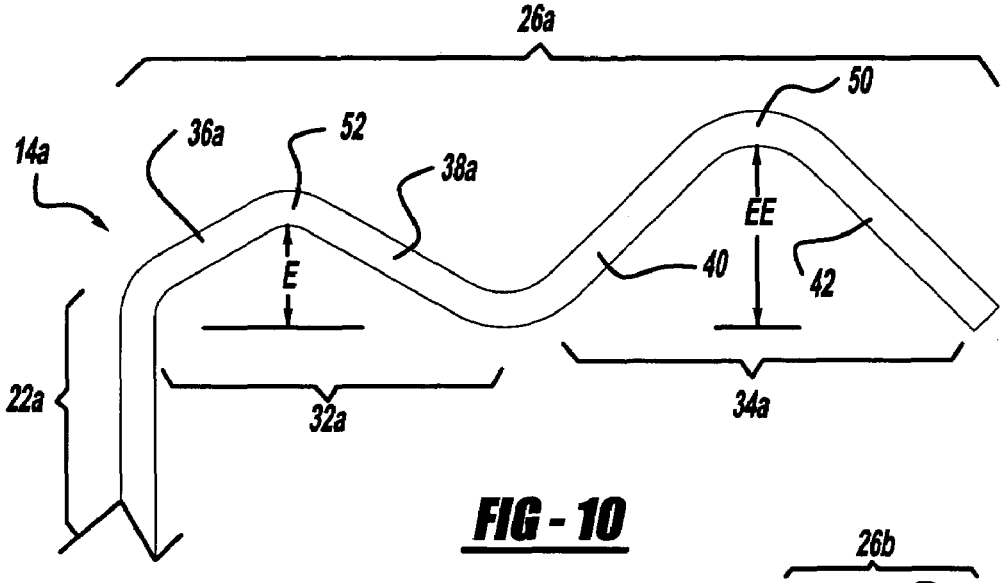
FIG. 10 is an enlarged fragmentary view of a portion of the retainer clip of FIG. 8 taken in the Circle 10 in FIG. 8.

Looking now to FIGS. 8 and 10, the resilient clamp section 26*a* extends laterally from the connecting section 22*a* in the same direction as the lower support section 24*a*. The upper clamp section 26*a* has a clamping segment 32*a* connected to an actuating segment 34*a*. The clamping segment 32*a* has an open loop which in one form is generally in the shape of an inverted V and has an upwardly extending angulated arm portion 36*a* connected to a downwardly extending angulated arm portion 38*a*. The depth E of the inverted V is selected to overlap at least two of the rings 12 at the upper end of the stack of rings 12. Since the clamping segment 32*a* is resilient it can readily accommodate a reasonable range of dimensional tolerances of the stack of rings 12.

Looking now to FIG. 10, the outer end of the downwardly extending arm portion 38*a* is connected to the actuating segment 34*a* which is also formed in the shape of an inverted V with a radiused peak. Other contours could be used such as ones having a generally arcuate shape for example an inverted U-shape with a generous radius. This is done to facilitate gripping and actuation by the operator. Thus the actuating segment 34*a* has a first arm portion 40 which is angulated upwardly away from the clamping segment 32*a*. A second arm portion 42 is angulated downwardly from the first arm portion 40 to thereby provide the actuating segment 34*a* with the inverted V. Here the peak 50 of the actuating segment 34*a* extends above the peak 52 of the clamping segment 32*a* whereby the inverted V of the actuating segment 34*a* will have a depth EE greater than the depth E of the clamping segment 32*a*. This also facilitates gripping by the operator.

Again the clamping segment 32*a* can be resiliently moved upwardly to facilitate insertion of the stack of rings 12 into the open loop 28*a* of the bottom support section 24*a*. Then the clamping segment 32*a* is moved over the top of the stack of rings 12. The actuating segment 34*a* is released whereby the clamping segment 32*a* will be resiliently moved over the top of the upper ones of the stack of rings 12 to then hold the rings 12 firmly in the stacked arrangement for handling as noted. The upward, actuated position of the clamp section 26*a* with its clamping segment 32*a* is shown in phantom in FIG. 7 and indicated by the prime numbers, i.e. clamp section 26*a*', clamping segment 32*a*' and actuating segment 34*a*'. Now the end user's operator will simply reverse the above noted process to remove the clamp section 26*a*' and clamping segment 32*a*' out of engagement with the stack of rings 12 to release the rings 12 for assembly to other components.

It can be seen that retainer clips 14, 14*a* of various sizes can be made to facilitate use with rings 12 of different sizes. The retainer clips 14, 14*a* can also be varied in size for use with different numbers of rings 12 in a stacked position. It can also be appreciated that both of the retainer clips 14, 14*a* can be repeatedly used.

It can be seen that the angulated arm portions 36 and 38 and 36*a* and 38*a* of the inverted V will provide minimal contact with the uppermost ring 12. At the same time the angulated structures will generally bias the connecting sections 22 and 22*a* away from contact with the outer surface of the rings 12. With this spacing of the clips 14, 14*a* away from the stack of rings 12, there will be substantially no effect on the heat treat of the rings 12 or on the subsequent oil or other corrosion inhibiting coating. In this regard even where there is some contact the circular cross-section of the clips 14, 14*a* will still provide only minimal contact and thus will have an insignificant effect on heat treat and the application of corrosion inhibiting coatings.

In this regard in contrast to the prior use of foil wrap for holding the rings 12, the clips 14, 14*a* improve the overall application of coverage of the rings 12 with corrosion inhibiting coatings. They also provide easier visual inspection by the end user of any corrosion while in storage. In addition, it should be understood that the stack of rings 12 as held together by the clips 14, 14*a* are also readily accessible for the effective application of other coatings, such as lubricants, on the inside and outside diameters.

A modified form of the retainer clip 14*a* is shown in FIGS. 12–15. There the like components will be given the same numerical designation with the addition of the postscript letter "b". Unless described otherwise the similarly numbered components will be the same and function the same.

Looking now to FIG. 12, a fragmentary pictorial view of an assembly 10*b* is shown of a plurality of the retaining rings 12 held in a stacked condition by a plurality of wirelike retainer clips 14*b*. As noted previously, the details of a specific form of retaining ring 12 are shown in FIG. 6.

The details of the retainer clip 14*b* can be readily seen in FIGS. 12–15. As noted the clip 14*b* is made from a wire of a resilient, high strength metal and, in one form, has a generally circular cross section. The clip 14*b* has an elongated, connecting section 22*b* terminating at the bottom in a lower support section 24*b* defined by an open loop. A resilient clamp section 26*b* is located at the opposite upper end of the connecting section 22*b*.

The lower support section 24*b* is substantially identical to the lower support sections 24, 24*a* while the resilient clamp section 26*b* is substantially identical to the resilient clamp section 26*a*. Thus the description of the details of the lower support section 24*b* and the clamp section 26*b* have been omitted for purposes of brevity and simplicity.

The connecting section 22*b*, however, is different from the straight, connecting sections 22, 22*a* and is formed with a transversely extending resilient extension segment 44 which permits the overall height or length of the retainer clip 14*b* to be selectively varied to accommodate stacks of rings, such as retaining rings 12, in an increased range of varying overall stack lengths.

As can be seen, the extension segment 44 is located generally midway along the length of the connecting section 22*b* and is generally triangularly shaped by a pair of arms 46 and 48 connected together at an included angle AN which in one form was around 110°. The structure facilitates manual extension of the overall length of the connecting section 22*b*. As can be seen by forming the extension segment 44 to extend transversely to the lower support section 24*b* and upper clamp section 26*b*, it will be in a plane extending relatively close to and somewhat tangent to the outer surface of the stack of rings 12. Thus the separation between the extension segment 44 and the outer surface of the stack of rings 12 will be minimized to provide an overall compact assembly to thereby facilitate handling, shipping, etc.

The actuated, extended condition of the resilient extension segment 44 is shown in FIG. 15 and is noted as 44' with the arms noted as 46' and 48'. There the extension segment 44' has been resiliently pulled by actuation of the clamp section 26*b* to separate the arms 46' and 48' whereby the angle AN is increased to angle AN' and the overall gripping length L of the retainer clip 14*b* could be increased to accept a variable number of additional rings 12'. On the other hand, with the variability of the length L, stacks of rings 12 of different thicknesses and a range of different overall stack lengths could be readily handled. In this regard, it is believed that the resilience of the extension segment 44 also assists in manually actuating the connecting section 22*b* to clamp the rings 12 in a stack and to later release the rings 12 from the stack. In this regard, the extension segment 44 then provides an increase in the range of the overall stack length in addition to that provided by the resilient clamp section 26*b*.

However, it should be noted that extension segments 44 of varying shapes could be used, i.e. different angles A or various expandable contours such as arcuate, etc. Also it may be feasible to provide more than one extension segment 44. Also, again, the clip 14*b* can be repeatedly used.

Figure 13:
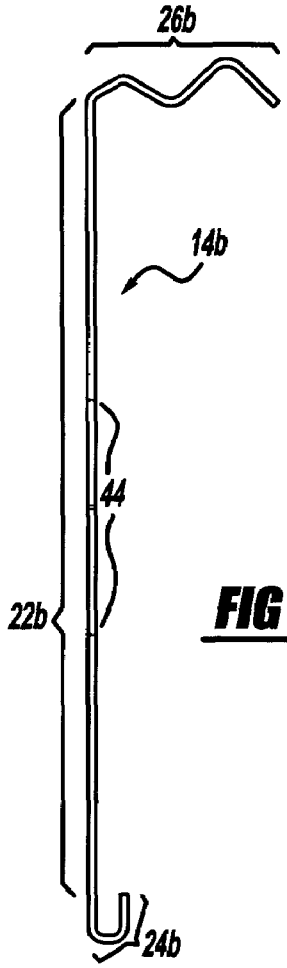
FIG. 13 is a side elevational view of one of the modified retainer clips of FIG. 12.
Figure 16:
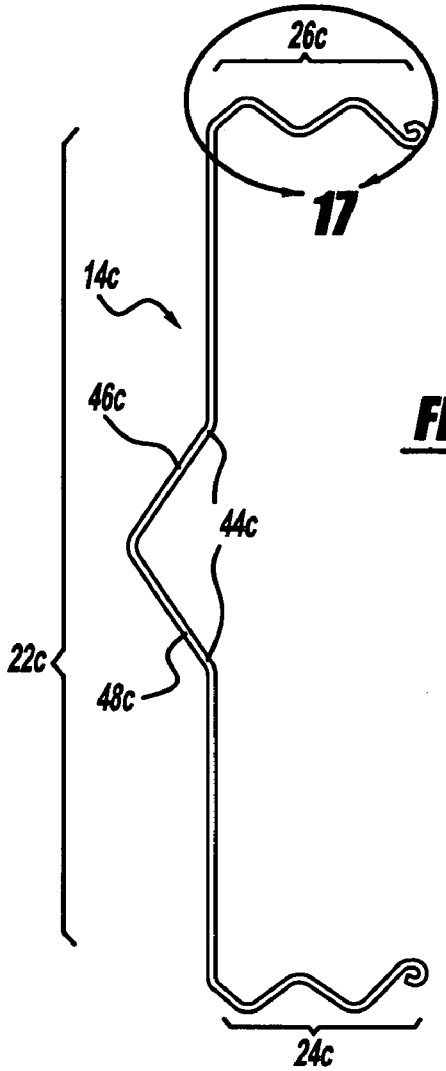
FIG. 16 is a side elevational view of a modified retainer clip similar to that of FIGS. 13 and 14 with a modified extension segment to extend generally radially outwardly from the stack of retaining rings and with other modified sections.

Looking now to FIG. 16, a retainer clip 14*c* is of a construction and form similar to retainer clip 14*b* of FIGS. 13 and 14 and is provided with an extension segment 44*c* which is formed to extend oppositely from the upper clamp section 26*c* and lower support section 24*c*. Thus the extension segment 44*c* will extend outwardly radially or transversely from the outer surface of a stack of rings such as rings 12. Thus the extension segment 44*c* is essentially open to the operator which then facilitates the manual engagement of the extension segment 44*c* by the operator to assist the manual gripping and handling of an assembly, such as assembly 10*b* of the stack of rings 12. In this regard, the opening of the extension segment 44*c* can be large enough to accept at least one of the fingers of the operator to facilitate gripping and manual handling.

In the retainer clip 14*c* the clamp section 26*c* has been somewhat modified from the clamp sections 26*a* and 26*b*. In addition, the lower support section 24*c* is substantially identical to clamp section 26*c* for a purpose to be seen.

Figure 17:
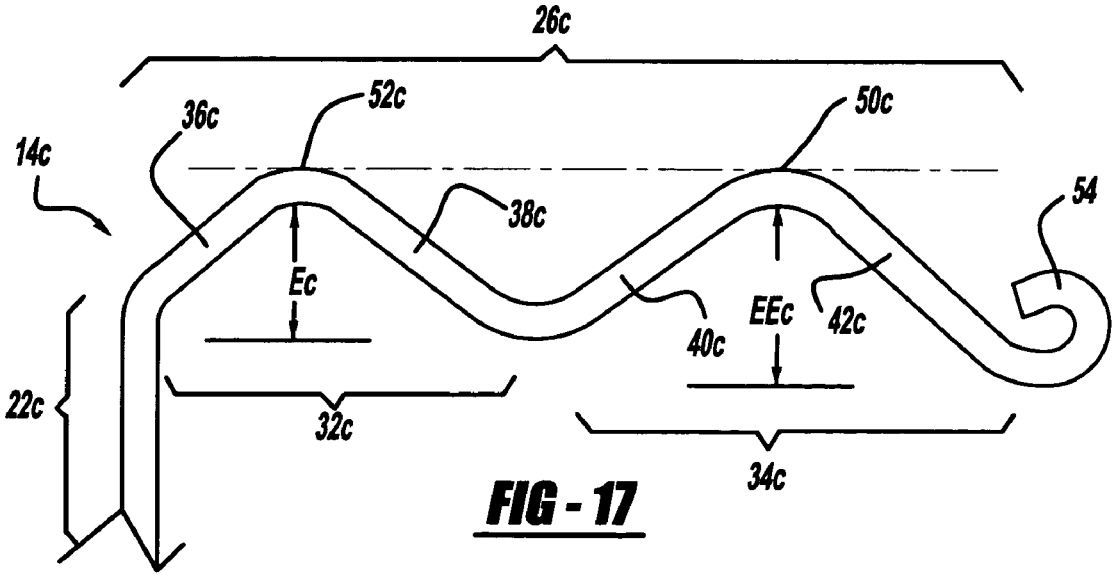
FIG. 17 is an enlarged fragmentary view of a portion of the clamp section of the retainer clip of FIG. 16 taken in the Circle 17 in FIG. 16.

Looking now to FIGS. 16 and 17 the clamp section 26*c* includes a clamping segment 32*c* which is substantially the same as clamping segment 32*a* with arm portions 36*c* and 38*c* oriented similarly to arm portions 36*a* and 38*a*, respectively, with a depth Ec somewhat greater than the depth E. The actuating segment 34*c*, however, is modified from actuating segment 34*a*. Here the arm portions 40*c* and 42*c* are joined to provide a generally V shape, however, with the peak or crest 50*c* at a position generally transversely in line with the peak or crest 52*c* of the clamping segment 32*c*. The outer lowermost end of the arm portion 42*c*, however, extends downwardly, further than the end of the arm portion 38*c*. Thus the depth EEc of the actuating segment 34*c* is again somewhat greater than the depth Ec of the clamping segment 32*c*. In addition the outer lowermost end of the arm portion 42*c* is provided with an outwardly curved generally closed loop 54. This provides a smooth surface to facilitate insertion of the operator's finger into the actuating segment 34*c*. In this regard a similar type loop could be provided on the lower end of the arm portion 42 of the clamp section 26*a* and the upper end of the actuating segment 34 of the clamp section 26.

In addition to the above, the lower support section 24*c* is substantially identical to the clamping section 26*c* and therefore the details thereof have been omitted for purposes of brevity and simplicity. Thus the lower support section 24*c* can also be manually actuated by the operator to release or engage the rings 12 in a stack.

In this regard it can be seen from FIG. 17 that the crests 50*c* and 52*c* are substantially at the same level. This facilitates its use as the lower support section 24*c*. This will also provide additional resilience whereby the range of the length of the stack of rings 12 will be increased. It should be understood, however, that the clip 14*c* could be formed with a lower support section similar to lower support section 24. Also, the clamp section 26*c* could be used with the clip 14*c* formed without the extension segment 44*c*.

Also since the crests 50*c* and 52*c*, and related crests on the lower support section 24*c*, are substantially transversely in line they will provide a relatively even support for the bottom of the stack of rings 12 in an upright position. Also, since the clamp section 26*c* and support section 24*c* are substantially the same, the clip 14*c* can be used without the need for any special orientation with either element 24*c* and 26*c* serving as the lower support section or the clamp section. Since, except as otherwise described, the details of the elements 22*c*, 44*c*, 46*c* and 48*c* are essentially the same as the elements 22*b*, 44*b*, 46*b* and 48*b* the description of such details have been omitted for purposes of brevity and simplicity. It should be understood, however, that the contour of the extension segment 44*c* including the arms 46*c* and 48*c* could be varied to facilitate different forms of manual gripping and extension. In addition, the various sections could be formed with different cross-sections if desired.

A modified form of the retainer clip 14*b* is shown in FIGS. 18–21. There the like components will be given the same numerical designation with the addition of the postscript letter "d". Unless described otherwise the similarly numbered components will be the same and function the same.

Figure 18:
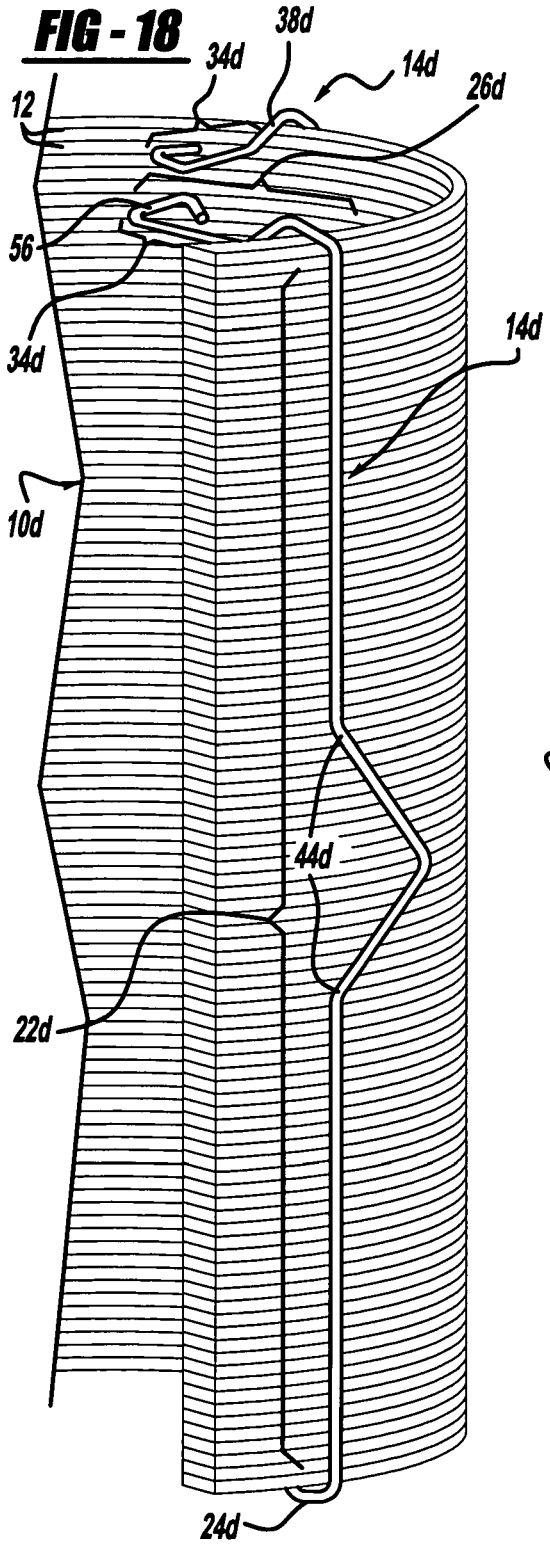
FIG. 18 is a fragmentary perspective view similar to FIG. 12 depicting the stack of retaining rings held together by a plurality of wirelike retainer clips of a modified form of the retainer clip of FIGS. 12–15 with a resilient length or height extension segment.
Figure 19:
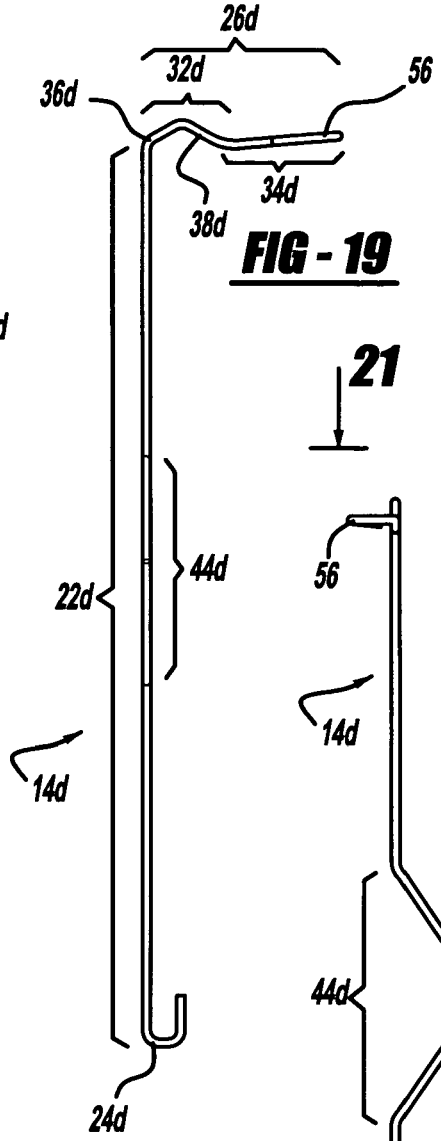
FIG. 19 is a side elevational view of one of the modified retainer clips of FIG. 18.
Figure 20:
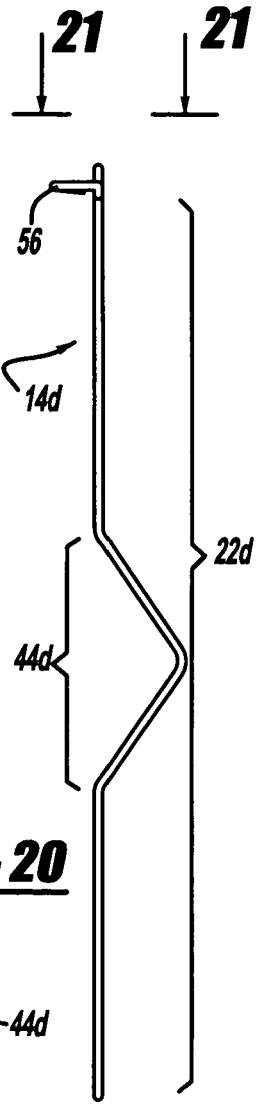
FIG. 20 is an end elevational view of one of the retainer clips of FIG. 18.
Figure 21:
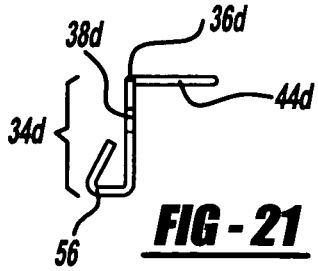
FIG. 21 is a top elevational view of the retainer clip of FIG. 18 taken in the direction of the Arrows 21—21 in FIG. 20.

Looking now to FIG. 18, a fragmentary view of an assembly 10*d* is shown of a plurality of the retaining rings 12 held in a stacked condition by a plurality of wirelike retainer clips 14*d*. As noted previously, the details of one form of a retaining ring 12 are shown in FIG. 6.

The details of the retainer clip 14*d* can be readily seen in FIGS. 18–21. As noted the clip 14*d* is made from a wire of a resilient, high strength metal and, in one form, has a generally circular cross section. The clip 14*d* has an elongated, connecting section 22*d* terminating at the bottom in a lower support section 24*d* defined by an open loop. A resilient clamp section 26*d* is located at the opposite upper end of the connecting section 22*d*.

The lower support section 24*d* is substantially identical to the lower support sections 24, 24*a*, 24*b* while the resilient clamp section 26*d* is modified from the resilient clamp section 26*b*. Thus the description of the details of the lower support section 24*d* have been omitted for purposes of brevity and simplicity.

The connecting section 22*d* is also generally the same as straight, connecting sections 22*b* and is formed with a transversely extending resilient extension segment 44*d* which permits the overall height or length of the retainer clip 14*d* to be selectively varied to accommodate stacks of rings, such as retaining rings 12, in an increased range of varying overall stack lengths.

The actuated, extended condition of the resilient extension segment 44*d* is the same as that of extension segment 44 as shown in FIG. 15 for the retainer clip 14*b*. Thus since the extension segment 44*d* is substantially identical to the extension segment 44, the description of the details of the extension segment 44*d* have been omitted for purposes of brevity and simplicity.

Looking now to FIGS. 18 through 21, the resilient clamp section 26*d* extends laterally from the straight connecting section 22*d* in the same direction as the lower support section 24*d*. The upper clamp section 26*d* has a clamping segment 32*d* connected to an actuating segment 34*d*. The clamping segment 32*d* is similar to the clamping segments 32 and 32*a*–*c* and thus has an open loop which in one form is generally in the shape of an inverted V and has an upwardly extending angulated arm portion 36*d* connected to a downwardly extending angulated arm portion 38*d*.

The outer end of the downwardly extending arm portion 38*d* is connected to the actuating segment 34*d* which extends generally transversely from the arm portion 38*d* and thus generally radially into the center of the stack of rings 12. The actuating segment 34*d* is generally planar and terminates at its outer end in a generally closed loop 56 which is generally triangular in shape. The loop 56 is in the same plane as the arm portion 38*d* with the opening of the loop 56 facing upwardly. Thus the actuating segment 34*d* is located axially inwardly from the top of the stack of rings 12. It can be seen that the planar structure of the actuating segment 34*d* with the loop 56 provides a substantial generally flat, planar surface for engagement by the operator. The actuating segment 34*d* is adapted to be engaged by an operator so that the clamping segment 32*d* can be resiliently moved axially upwardly to facilitate insertion of the stack of rings 12 into the open loop 28*d* of the bottom support section 24*d*. Thus the actuating segment 34*d* facilitates engagement and actuation by the operator for both clamping and releasing a stack of rings 12.

It should be understood that bottom support section 24*d* could be made substantially the same as the clamp section 26*d* and also that the clamp section 26*d* could be used with a clip 14*d* without the extension segment 44*d*.

In this regard, the location of the actuating segment 34*d* radially inwardly also facilitates use of the form of the clamp section 26*d* as the lower support section 24*d*.

As noted the wirelike clips, such as clips 14 and 14*a*–14*d*, are made from a material of a resilient, high strength metal and have a generally circular cross section as shown in FIG. 22*a*.

In one form of the invention the retainer clips 14 and 14*a*–14*d* could be a wirelike member made of a high carbon steel alloy wire of ASTM A228 or A227 and A229.

In this regard the tensile strength of the clips 14 and 14*a*–14*d* as formed will not be affected by a typical heat treat step for the rings 12 previously discussed. This facilitates frequent re-use of the clips 14 and 14*a*–14*d*. In one form, with a circular cross-section as shown in FIG. 22*a*, the diameter of the wire could be around 0.080 inches±0.002 inches. With regard to the clips 14, 14*a* and 14*d* the bottom support sections 24, 24*a* and 24*d* the dimension A could be between around 0.157 inches±0.02 inches and around 0.234 inches±0.02 inches. At the same time the length of the depth C could be around 0.425 inches. In addition in one form, the overall gripping length L between the clamping segments 32, 32*a*–32*d* and bottom of the support sections 24 and 24*a*–24*d* could be between around 8.85 inches±0.04 inches to around 12.40 inches±0.04 inches. As noted the above dimensions can be selectively varied for retaining rings 12 of different sizes and different numbers to be stacked in stacks of different lengths for handling. In this regard the depth "d" of the generally triangular contour of the extension segments 44, 44*c* and 44*d* can be selectively varied and in one form, utilizing the dimensions noted above, the bottom of the support sections 24 and 24*a*–24*d* was around 0.70 inches.

Figure 22B:
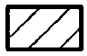
FIG. 22*b* is a cross section similarly taken as FIG. 22*a* but showing a generally flat, rectangular cross-section for a retainer clip.
Figure 22C:
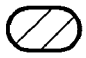
FIG. 22*c* is a cross-section similarly taken as in FIG. 22*a* showing a flat cross-section for a retainer clip similar to that of FIG. 22*b* but with arcuate ends.
Figure 22D:
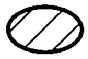
FIG. 22*d* is a cross-section for a retainer clip similarly taken as in FIG. 22*a* but with a generally oval cross-section.

Of course, wirelike retainer clips of a different cross section such as shown in FIGS. 22*b*–22*d* could be used depending on the application. Thus FIG. 22*b* depicts a cross-section for a wirelike clip which is of a generally flat, rectangular contour; FIG. 22*c* depicts a cross-section for a wirelike clip which is similar to that of FIG. 22*b* but with arcuate ends; and FIG. 22*d* depicts a cross-section for a wirelike clip of a generally oval contour. It can be seen that various cross-sections for wirelike clips as shown in FIGS. 22*b*–22*d* would provide the basic function of the circular cross-section of FIG. 22*a* and thus would provide an acceptable resilience and flexibility. In addition the confronting area of wirelike clips relative to the rings 12 when stacked with cross-sections of FIGS. 22*b*–22*d* would not be significantly greater than that of the circular cross-section of FIG. 22*a*. Thus from the description and drawings it can be seen a variety of wirelike clips of various constructions can be used.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. Retainer clips for securing together a plurality of rings in a stack for handling for a variety of procedures such as processing, shipping and use in attachment to other members, each said retainer clip being of a flexible wirelike construction and having an elongated connecting section extending along the length of said rings when stacked, said retainer clip having a support section located at the lower end of said connecting section for receiving and supporting the lower end of the stack of rings, and a resilient clamp section located at the opposite upper end of said connecting section and being flexibly movable to facilitate movement over the opposite upper end of the stack of said rings to resiliently engage the opposite upper end of the stack of said rings to retain them with pressure against the support section and being flexibly movable away from the opposite upper end of the stack of rings to permit removal of said rings from the stack, a plurality of said retainer clips adapted to be located in spaced relationship about said rings in a stack to secure said rings in the stack for handling, said rings having a predetermined width and thickness, said clamp section having a clamping segment with an open loop having an upwardly extending opening adapted to overlap the width and thickness of at least the one of the rings at the top of the stack, said support section having an open loop with a downwardly extending opening adapted to receive and overlap the width and thickness of at least the one of the rings at the bottom of the stack.

2. The retainer clip of claim 1 with said connecting section being substantially straight and of a generally fixed length.

3. The retainer clip of claim 1 with said connecting section having a resilient extension segment whereby the overall length of said connecting section can be selectively increased over a predetermined range to accept rings in stacks of varying lengths.

4. The retainer clip of claim 3 with said resilient extension segment including a pair of spaced arms angulated apart at a preselected angle to permit resilient increase in said preselected angle and further separation of said spaced arms whereby rings in stacks of varying length can be accepted.

5. The retainer clip of claim 1 with said clamp section having an actuating segment connected to said clamping segment for actuation of said clamping segment resiliently upwardly to accept the stack of rings in clearance and releasable to overlap at least the one of the rings at the top of the stack to thereby clamp the stack of rings together.

6. The retainer clip of claim 5 with said actuating segment being angulated upwardly away from said clamping segment.

7. The retainer clip of claim 5 with said support section being resilient and having a support segment and an actuating segment connected to said support segment for actuation of said support segment away from the stack of rings to accept the stack of rings in clearance and releasable to overlap at least the one of the rings at the bottom of the stack to thereby clamp the stack of rings together.

8. The retainer clip of claim 1 with said clamp section having an actuating segment connected to said clamping segment for actuation of said clamping segment resiliently upwardly to accept the stack of rings in clearance and releasable to overlap at least the one of the rings at the top of the stack to thereby clamp the stack of rings together, said actuating segment having an outer end with a substantially closed loop to provide a generally smooth surface at said outer end to facilitate engagement with said actuating segment.

9. The retainer clip of claim 1 with said clamp section having an actuating segment connected to said clamping segment for manual actuation of said clamping segment resiliently upwardly to accept the stack of rings in clearance and releasable to overlap at least the one of the rings at the top of the stack to thereby clamp the stack of rings together, said actuating segment having an outer end with a substantially closed loop to provide a generally smooth surface at said outer end to facilitate the manual actuation.

10. The retainer clip of claim 9 with said support section being resilient and having a support segment and an actuating segment connected to said support segment for manual actuation of said support segment away from the stack of rings to accept the stack of rings in clearance and releasable to overlap at least the one of the rings at the bottom of the stack to thereby clamp the stack of rings together.

11. The retainer clip of claim 1 with said clamp section having an actuating segment connected to said clamping segment for actuation of said clamping segment resiliently upwardly to accept the stack of rings in clearance and releasable to overlap at least the one of the rings at the top of the stack to thereby clamp the stack of rings together, said actuating segment having an upwardly extending open loop adapted to be engaged from the inside of said open loop for resiliently moving said clamp from engagement with the stack of rings, said open loop of said actuating segment having an outer end with a substantially closed loop to provide a generally smooth surface at said outer end to facilitate engagement with said actuating segment.

12. The retainer clip of claim 1 with said clamp section having an actuating segment connected to said clamping segment for actuation of said clamping segment resiliently upwardly to accept the stack of rings in clearance and releasable to overlap at least the one of the rings at the top of the stack to thereby clamp the stack of rings together, said actuating segment having a generally straight section extending radially from the end of said open loop of said clamping segment, the outer end of said straight section connected to a substantially closed loop section with the opening of said closed loop section facing upwardly whereby a generally smooth surface is provided at said outer end to facilitate engagement with said actuating segment.

13. The retainer clip of claim 12 with said actuating segment extending downwardly below said clamping segment.

14. The retainer clip of claim 1 with said resilient clamp section being resiliently movable to clamp stacks of rings in a range of varying lengths.

15. The retainer clip of claim 14 with said connecting section having a resilient extension segment whereby the overall length of said connecting section can be selectively increased over a predetermined range to accept rings in stacks of varying lengths in addition to the varying length of stacks provided by said resilient clamp section.

16. The retainer clip of claim 1 with said support section being resiliently movable to clamp stacks of rings of varying length.

17. The retainer clip of claim 16 with said connecting section having a resilient extension segment whereby the overall length of said connecting section can be selectively increased over a predetermined range to accept rings in stacks of varying lengths in addition to the varying length of stacks provided by said support section.

18. The retainer clip of claim 1 with said resilient clamp section and said support section being resiliently movable to clamp stacks of rings of varying length.

19. The retainer clip of claim 18 with said connecting section having a resilient extension segment whereby the overall length of said connecting section can be selectively increased over a predetermined range to accept rings in stacks of varying lengths in addition to the varying length of stacks provided by said resilient clamp section and by said resilient support section.

20. The retainer clip of claim 1 with said connecting section having a resilient extension segment whereby the overall length of said connecting section can be selectively increased over a predetermined range to accept stacks of rings of varying lengths, said extension segment being generally located in a plane extending generally radially transversely to the stack of rings whereby said extension segment will provide an opening to facilitate gripping of the stack of rings by the operator.

21. The retainer clip of claim 1 with said wirelike construction having a cross-section with a diameter of around 0.080 inches.

22. The retainer clip of claim 1 with said support section and said resilient clamp section being adapted to locate said connecting section spaced from the outer surface of the rings when said rings are held in a stacked condition by said clip.

23. The retainer clip of claim 22 with said spacing of said connecting section from the outer surface of the stack of rings facilitating processing of the rings such as by heat treatment or coating when stacked.

24. The retainer clip of claim 1 with said clip being made of a resilient, high strength metal.

25. The retainer clip of claim 1 with said clamp section being resiliently movable over the upper end of the stack of rings during assembly and releasable to resiliently engage the upper end of the stack rings to retain them in a stacked condition.

26. A retainer clip for securing together a plurality of rings in a stack for handling for a variety of procedures such as processing, shipping and use in attachment to other members, said retainer clip being of a flexible wirelike construction and having an elongated connecting section, a support section located at the lower end of said connecting section for receiving and supporting the lower end of the stack of rings, and a resilient clamp section located at the opposite upper end of said connecting section and being flexibly movable to facilitate movement over the opposite upper end of the stack of rings to resiliently engage the opposite upper end of the stack of rings to retain them with pressure against the support section and being flexibly movable away from the opposite upper end of the stack of rings to permit removal of the rings from the stack, with the rings having a predetermined width and thickness, said clamp section having a clamping segment with an open loop having an upwardly extending opening adapted to overlap the width and thickness of at least the one of the rings at the top of the stack, said clamp section having an actuating segment connected to said clamping segment for actuation of said clamping segment resiliently upwardly to accept the stack of rings in clearance and releasable to overlap at least the one of the rings at the top of the stack to thereby clamp the stack of rings together, said actuating segment having an upwardly extending open loop adapted to be engaged from the inside of said open loop for resiliently moving said clamp section with said clamp segment moved away from clamping engagement with the stack of rings.

27. The retainer clip of claim 26 with said open loop of said clamping segment and said open loop of said actuating segment having crests substantially at the same height.

28. The retainer clip of claim 26 with said connecting section having a resilient extension segment whereby the overall length of said connecting section can be selectively increased over a predetermined range to accept stacks of rings of varying lengths, said extension segment being generally located in a plane extending generally transversely to said support section and said clamp section whereby said extension segment will be located in close proximity to the radially outer surface of the stack of rings to provide an overall compact assembly.

29. The retainer clip of claim 28 with said resilient segment including a pair of spaced arms angulated apart at a preselected angle to permit resilient increase in said preselected angle and further separation of said spaced arms whereby rings in stacks of varying length can be accepted.

30. The retainer clip of claim 28 with said resilient segment including a pair of spaced arms angulated apart at a preselected angle to permit resilient increase in said preselected angle and further separation of said spaced arms whereby rings in stacks of varying length can be accepted, said preselected angle being around 120°.

31. A method of securing together a plurality of rings in a stack for handling for a variety of procedures such as processing, shipping and use in attachment to other members, comprising the steps of:

providing a retainer clip of a flexible wirelike construction and having an elongated connecting section for securing said rings in the stack, said retainer clip having a support section located at the lower end of said connecting section for receiving and supporting one end of the stack of said rings, and a resilient clamp section located at the opposite upper end of said connecting section and being flexibly movable to facilitate movement over the opposite end of the stack of said rings to resiliently engage the opposite end of the stack of said rings to retain them with pressure against the support section and being flexibly movable away from the opposite end of the stack of said rings to permit removal of the rings from the stack.

32. The method of claim 31 including the step of securing said rings in the stack with at least three of said retainer clips.

33. The method of claim 31 with said rings being of a split ring type with a gap, actuating said retainer clip to maintain said gap of each of said rings in alignment when said rings are held in a stack by said retainer clip.

34. The method of claim 33 including the step of securing said rings in the stack with at least three of said retainer clips.

35. The method of claim 31 with said clamp section being resiliently movable over the upper end of the stack of rings during assembly and releasable to resiliently engage the upper end of the stack of rings to retain them in a stacked condition.

36. A retainer clip for securing together a plurality of rings in a stack for handling for a variety of procedures such as processing, shipping and use in attachment to other members, said retainer clip being of a flexible wirelike construction and having an elongated connecting section, a support section located at the lower end of said connecting section for receiving and supporting the lower end of the stack of rings, and a resilient clamp section located at the opposite upper end of said connecting section and being flexibly movable to facilitate movement over the opposite upper end of the stack of rings to resiliently engage the opposite upper end of the stack of rings to retain them with pressure against the support section and being flexibly movable away from the opposite upper end of the stack of rings to permit removal of the rings from the stack, said clip holding said rings together in a stacked relationship to facilitate heat treatment of the rings, said retainer clip being made of a flexible metal of preselected strength whereby the tensile strength of said clip will not be affected by the heat treat step.

37. A retainer clip for securing together a plurality of rings in a stack for handling for a variety of procedures such as processing, shipping and use in attachment to other members, said retainer clip being of a flexible wirelike construction and having an elongated connecting section, a support section located at the lower end of said connecting section for receiving and supporting the lower end of the stack of rings, and a resilient clamp section located at the opposite upper end of said connecting section and being flexibly movable to facilitate movement over the opposite upper end of the stack of rings to resiliently engage the opposite upper end of the stack of rings to retain them with pressure against the support section and being flexibly movable away from the opposite upper end of the stack of rings to permit removal of the rings from the stack, said clip holding said rings together in a stacked relationship to facilitate heat treatment of the rings, said retainer clip being made of a resilient, high strength metal whereby the tensile strength of said clip will not be affected by the heat treat step.

* * * * *